United States Patent [19]

Gessinger et al.

[11] 4,096,460

[45] Jun. 20, 1978

[54] RELAY

[75] Inventors: Herald Gessinger, Bernhardsthal; Manfred Baumruck, Vienna; Dietrich Kral, Wordern, all of Austria

[73] Assignee: International Standard Electric Corporation, New York, N.Y.

[21] Appl. No.: 737,970

[22] Filed: Nov. 2, 1976

[30] Foreign Application Priority Data

Nov. 14, 1975 Austria ..... 8684/75

[51] Int. Cl.[2] ..... H01H 50/64

[52] U.S. Cl. ..... 335/136; 335/119

[58] Field of Search ..... 335/136, 137, 135, 160, 335/192, 129, 131, 119, 120

[56] References Cited

U.S. PATENT DOCUMENTS

| | | | |
|---|---|---|---|
| 2,558,067 | 6/1951 | Wells | 335/136 |
| 2,658,123 | 11/1953 | Stoeser | 335/136 |
| 2,762,883 | 9/1956 | Lang | 335/136 |
| 3,201,544 | 8/1965 | Diamant | 335/136 |

*Primary Examiner*—Harold Broome

*Attorney, Agent, or Firm*—John T. O'Halloran; Jeffrey P. Morris

[57] ABSTRACT

Relay having contact springs operated by a shifting member, which is mechanically held in one or two end positions. The shifting member is shiftable by one or two magnetic drive systems. It is provided with two over-center springs at one end or at each end. The over-center springs bear at one end on the movable shifting member and on the other end on a fixed point, which is connected to the body of the relay. Monostable relays are provided with a return spring.

16 Claims, 16 Drawing Figures

RELAY

BACKGROUND OF THE INVENTION

This invention relates to a relay having contact springs operated by a shifting member, which is mechanically held in one or two end positions.

Relays are known which comprise locking mechanisms, such as are used in so-called latch relays, in which the relay contacts are held in their end positions by mechanical means. These locking mechanisms often occupy a large space and are not highly reliable owing to abrasion.

The invention avoids these disadvantages and relates to a relay which can be used particularly in modern printed circuit technology and is correspondingly small.

SUMMARY OF THE INVENTION

The relay with shifting member according to the invention is characterized in that the shifting member is shiftable by one or two magnetic driving systems by the armatures thereof, that the shifting member is provided with two over-center springs at one end or at each end, that said over-center springs bear at one end on the movable shifting member and at the other end on a fixed point, which is connected to the body of the relay, that said over-center springs when provided only at one end are provided at their other end with a return spring, that in a relay comprising two magnetic driving systems the difference between the distance between the abutment bearings of the shifting member and the distance between the fixed abutment bearings is between zero and substantially the length of the shifting movement of the shifting member and that in a relay comprising only one magnetic driving system the movable abutment bearings are substantially aligned with the fixed abutment bearings and the shifting member has shoulder surfaces which are engaged by the contact springs and serve to positively constrain the latter.

To stabilize the constraint of the shifting member, it is a preferred feature of the invention that the over-center springs consist of leaf springs. According to a preferred feature of the invention, these leaf springs may be omega-shaped and may be squarely cut or beaded at the bearing ends.

According to a preferred further feature of the invention, the abutment bearings provided for the over-center springs in the movable member and in the fixed abutment are tub-shaped.

To avoid a false switching in case of a breakage of an over-center spring, a preferred feature of the invention resides in that a guide is provided in the shifting member and has offset cross-sections, and an element fixedly connected to the yoke of the relay is guided in said guide and in case of a canting of the shifting member due to a defective over-center spring engages the shoulder of the offset cross-section so that this interengagement prevents a movement of the shifting member.

According to a preferred feature of the invention, screws are provided which serve to secure the relay yokes to the base for the relay springs and which are screwed into the relay yoke and have an extended head which is adapted to be inserted through a hole in the base for the relay springs and has adjacent to the slot of the screw a smaller cross-section defining an annular groove, which is adapted to receive wedges or wedge springs extending at right angles to the axis of the screw for a final fixation.

Finally, according to a preferred feature of the invention, a reliable opening of contacts which have become welded together is enabled in that the fixed contact springs are embedded in plastics material as far as to a point which is close to the contact point, and the movable contact springs are stiffened in and beyond the zone of the contact point in that the cut side edges of the relay springs are beaded.

BRIEF DESCRIPTION OF THE DRAWING

Embodiments of the invention will now be explained more fully and by way of example with reference to the drawing, in which.

DESCRIPTION OF THE PREFERRED EMBODIMENT

Figure 1:
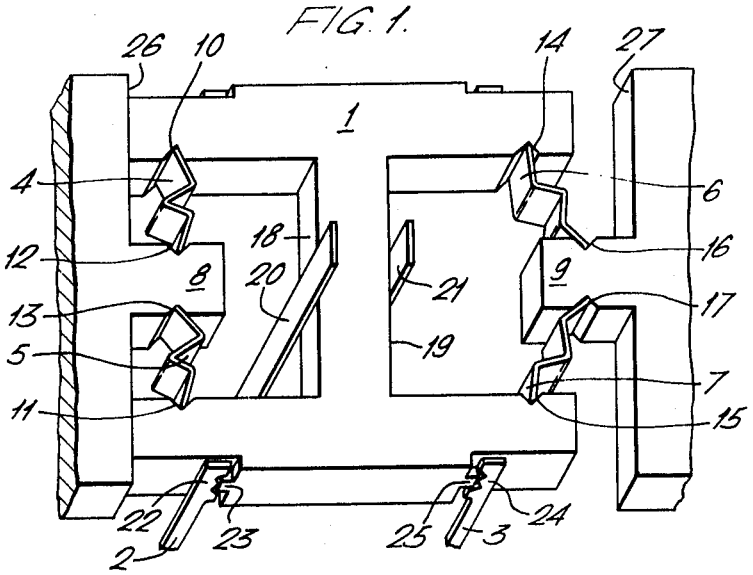
FIG. 1 is a portion of the relay according to the invention having two end positions (bistable relay); in this relay, the fixed bearings are close to each other.

According to FIG. 1, the response of the left-hand or right-hand armature causes the movable shifting member 1 to be shifted by the armatures 2 and 3 to the right or left, respectively, beyond the center of the possible stroke, and the shifting member then automatically engages all boundary surfaces 26 and 27. The shifting member 1 is constrained to move parallel to itself by springs, preferably pairs of leaf springs 4, 5 and 6, 7, respectively. The fixed part of the relay contains on each side a projection 8 or 9. The shifting member 1 and the projections 8 and 9 are formed with notches, in which the over-center springs abut. The over-center spring 4 abuts in bearings 10 and 12, the over-center spring 5 in bearings 13 and 11, the over-center spring 6 in bearings 14 and 16 and the over-center spring 7 in bearings 17 and 15. These over-center springs cooperate so as to hold the shifting member 1 in its left-hand and right-hand end positions, respectively. Details regarding the location of the bearings will be stated with reference to FIGS. 13 to 15. Notches 22 and 24 receive the projections 23 and 25 and serve to transmit the movement of the armatures 2 and 3 to the shifting member. The notches 22 and 24 and/or the projections 23 and 25 may be omitted so that the armature engages only a simple projection rather than a stepped projection. The armatures 2 and 3 may be duplicated on the opposite side but this is not essential. The shifting member 1 has shoulder surfaces 18 and 19 for actuating the contact springs 20 and 21.

Only two relay springs 20 and 21 are shown. Instead of two relay springs, a plurality of pairs of relay springs or individual relay springs may be provided. The contacts with which these movable relay springs 20 and 21 cooperate are not visible and consist of fixed contacts which are either disposed within the relay springs or entirely or partly outside the same. The movable contact springs may be guided in chambers disposed within the shifting member, and these chambers may also be used as spark-breaking chambers.

When the shifting member 1 has been shifted by the armatures 2 and 3 beyond the center and has then automatically shifted to one end position or the other, the shifting member and the movable contacts shifted by it remain in this position even when the magnetic force ceases to act and the armature no longer exerts a force. Only the other armature can shift the shifting member in the other direction to change the movable contacts. In the latter case, a magnetic force is no longer required when the position beyond the center and the automatically assumed end position have been reached and the exciting coil may then be deenergized, whereas the shifting member does not continue to move. This operation is described as bistable.

Figure 2:
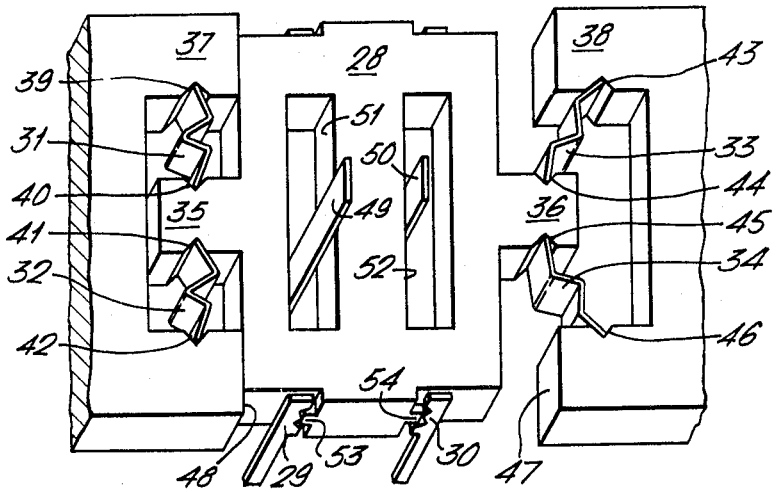
FIG. 2 shows a portion of another relay according to the invention with two end positions, in which the fixed bearings are widely spaced apart.

FIG. 2 shows an arrangement in which the movable and fixed bearings of FIG. 1 are reversed. The shifting member 28 is again moved to the right and left, respectively, by the armatures 29 and 30 through the intermediary of the projections 53 and 54 after which the shifting member arrives independently the areas of contact 47 and 48. The over-center spring 31 abuts in bearings 39 and 40, the over-center spring 32 in bearings 41 and 42, the over-center spring 33 in bearings 43 and 44 and the over-center spring 34 in bearings 45 and 46. The bearings are provided in extensions 35 and 36 of the shifting member and in the walls of the fixed members 37 and 38. The distances between the bearings are properly dimensioned as in FIG. 1; these dimensions will be described with reference to FIGS. 13 to 15. Only two of the contact springs, namely, 49 and 50, are shown. The contact springs cooperate with fixed contacts, which are not shown and are provided on fixed contact springs that are disposed within or entirely or partly outside the movable contact springs. The shifting member has shoulders 51 and 52 for actuating the contact springs.

Figure 3:
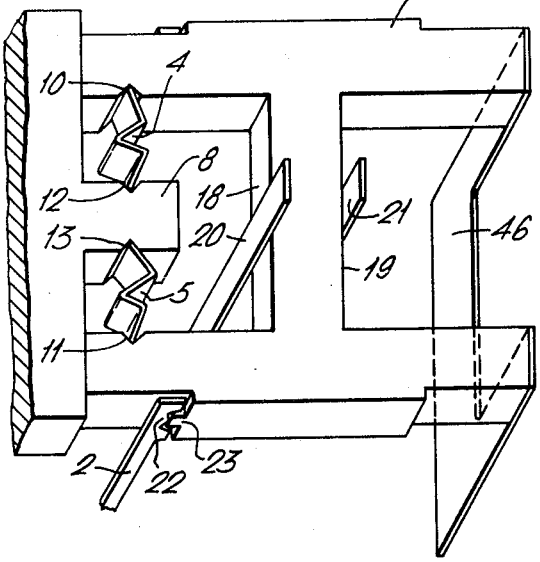
FIG. 3 shows a portion of another relay according to the invention which has one end position (monostable relay).

FIG. 3 shows the monostable embodiment of the relay according to the invention. This embodiment agrees substantially with the left-hand half of FIG. 1. Instead of the right-hand over-center springs, a return spring 46 is provided, which cooperates with the shifting member 1. In addition to exerting a spring action, the return spring contrains the shifting member 1 to move parallel to itself. upon an actuation of the armature 2, the shifting member 1 is shifted to the right by connecting means 22 and 23 against the force of the return spring 46 and in consideration of the force of the relay springs 20 and 21 and of the over-center springs 4 and 5. The optimum dimensions of the several springs will be described more fully with reference to FIG. 16.

Figure 4:
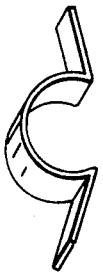
FIGS. 4 and 5 show emodiments of the omega-shaped over-center spring.
Figure 5:
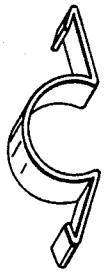

FIGS. 4 and 5 show an over-center spring consisting of an omega-shaped leaf spring. The ends are squarely cut in FIG. 4. To improve the guidance and to reduce the wear, the ends are beaded in FIG. 5. In the middle the springs have almost the configuration of three-fourths of a circle whereas the annexed portions are straight. This configuration affords the advantage that a large spring force can be accomodated in a very small space and the springs are reliably held in their bearings in all actuated positions and can be manufactured in a simple manner.

Figure 6:
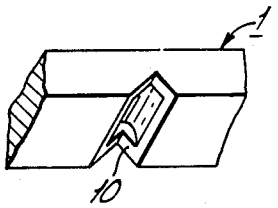
FIG. 6 shows the tube-shaped bearings.

Optimum results will be obtained if the preferred end formation shown in FIG. 5 is combined with tub-shaped bearings as shown in FIG. 6. For instance, the notches of the abutment bearing 10 in the shifting member 1 but possibly also those of the fixed bearings are internally tub-shaped so that the beaded end portions roll in the tubs and thus exert the smallest pressure per unit area in the stable position. With this design of the abutment bearings and of the ends of the overcenter springs, the wear will be minimized.

Figure 7:
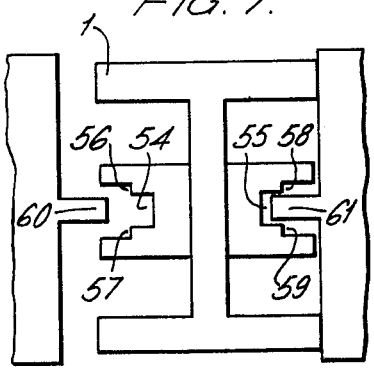
FIGS. 7 and 8 show how the shifting member is locked before and after a breakage of an over-center spring.
Figure 8:
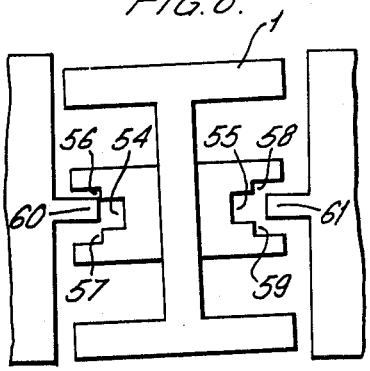

FIG. 7 shows means for preventing an actuation of the shifting member 1 when over-center springs are defective. Upon a movement of the shifting member, a projection 60 or 61 in the fixed part of the relay enters a recess 54 or 55. Upon a breakage of an over-center spring, the shifting member 1 is automatically canted, as is apparent from FIG. 8, so that the projection, e.g. 60 engages the step 56 to prevent a continued movement of the shifting member 1 and a wrong actuation of the contacts. The steps 57, 58 and 59 are for the same purpose.

Figure 9:
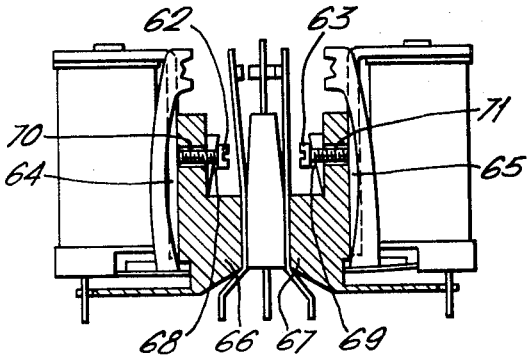
FIG. 9 shows the arrangement for the assembly.
Figure 10:
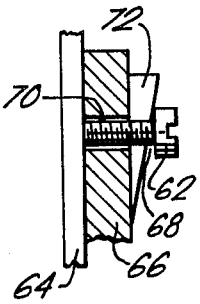
FIGS. 10 and 11 show the insertion of clamping elements for clamping the assembled members in position.
Figure 11:
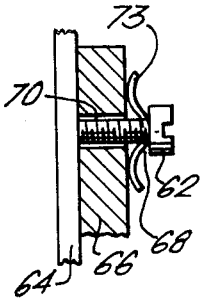

FIG. 9 shows how the relay is assembled in accordance with the invention. The screw heads 62 and 63 are not easily accessible and cannot be tightened with a conventional screwdriver. The screws serve to hold the fixed body 66 or 67 of the relay and the yoke 64 or 65 of the relay trough the bore-holes 70 or 71 together. This is accomplished in accordance with FIG. 10 by a wedge 72 and in accordance with FIG. 11 by a wedge spring 73, which are inserted into grooves 68 or 69 (not shown) on the head of the screw and by their wedge action clamp the screws in position at right angles to the direction in which the screws are conventionally fixed. The screws are previously screwed into the yoke and extended trough a hole in the set of fixed relay springs.

Figure 12:
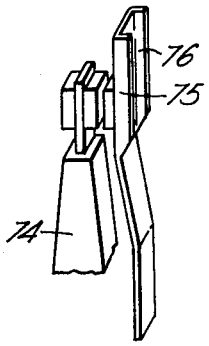
FIG. 12 illustrates the reinforcement of the contacts and springs for their separation when they have become welded together.

FIG. 12 shows measures which facilitate the opening of contacts that have become welded together, e.g., by an excessively high current. Such contacts would normally break and cause wrong switching operations. This measure also results in a reliable blocking of the shifting member 1 if the contacts have become welded together so firmly that they cannot be opened by the forces available in the relay. This sequence is required to ensure that the contact system moves under positive constraint. Such movement under positive constraint is required, e.g., in relays for safety functions. The fixed contact springs are embedded in plastics material to the highest possible level as is shown at 74. 75 and 76 are flangings on the movable contact-spring, which flangings serve for a stiffening of the contact-zone and so obviate the risk of breaking.

Figure 13:
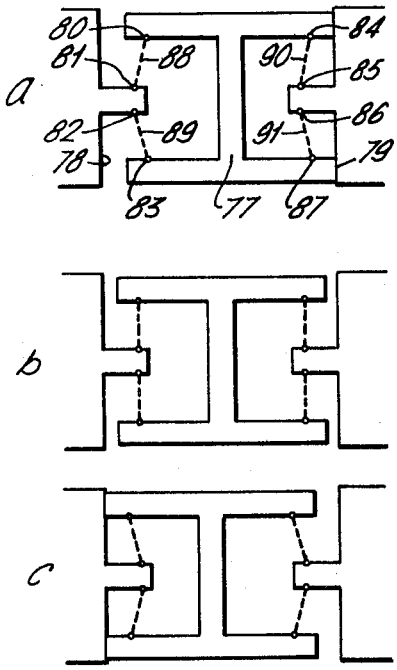
FIGS. 13 to 15 show diagrammatically the positions of the over-center springs in different arrangements of the bearings. Finally.
Figure 14:
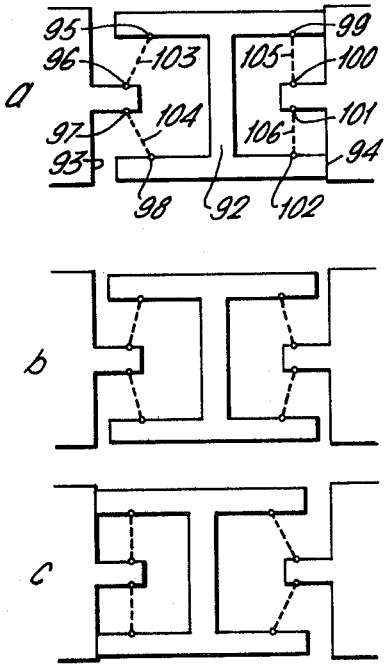
Figure 15:
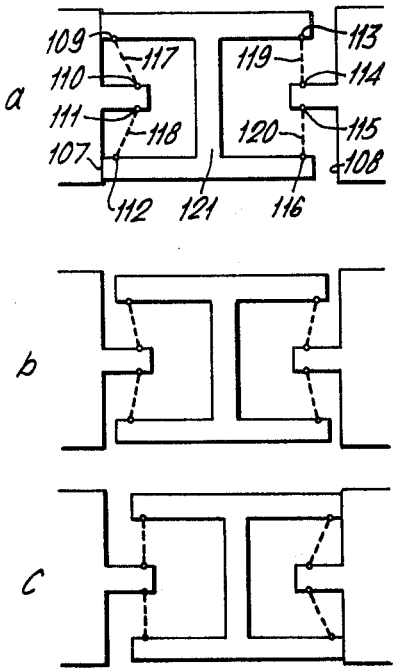

FIGS. 13 to 15 show possible locations of the movable and fixed abutment bearings, which are arranged in such a manner that a bistable behavior of the shifting member is ensured by the four over-center springs stressed between the abutment bearings.

In the arrangement shown in FIG. 13, where the distances measured between the movable abutment bearings 80, 84 and 83, 87 are as large as those between the fixed abutments 81, 85 and 82, 86 and the over-center springs 88 to 91 are aligned in both end positions, which are defined by the engagement of the shifting member 77 with the boundary surfaces 78 and 79 and in the unstable center position, i.e., throughout the stroke of the shifting member.

In FIG. 14, the distances measured between the movable abutment bearings 95, 99 and 98, 102 are shorter than the distances between the fixed abutment bearings 96, 100 and 97, 101. The difference between these distances is substantially as large as the shifting movement of the shifting member 92 so that the movable and fixed abutment bearings disposed on the engaging side of the shifting member are substantially aligned in the stable positions, which are defined by the engagement of the shifting member with the boundary surfaces 93 and 94. The over-center springs 103–106 are symmetrically arranged in the unstable center position of the shifting member.

In FIG. 15, the distances between the movable abutment bearings 109, 113 and 112, 116 exceed the distances between the fixed abutment bearings 110, 114 and 111, 115. The difference between these distances is substantially as large as the length of the shifting member 121 so that the movable and fixed abutment bearings on the side opposite to the engaging side are substantially aligned in the stable positions defined by the engagement of the shifting member with the boundary surfaces 107 and 108. The over-center springs 117 to 120 are symmetrically arranged in the unstable center position of the shifting member.

Figure 16:
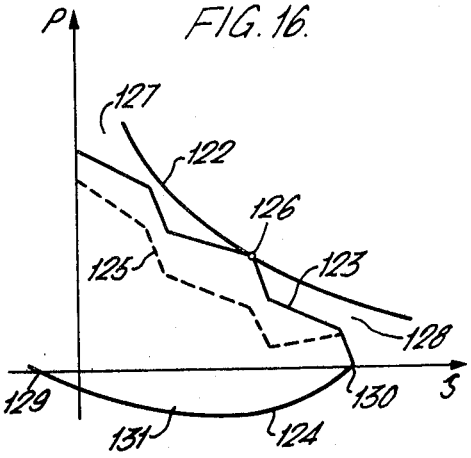
FIG. 16 shows diagrammatically the optimum dimensioning of the effective springs.

FIG. 16 shows the force-displacement characteristic of a monostable relay according to the invention, as is shown, e.g., in FIG. 3. In the diagram, the displacement *s* of the shifting member is plotted along the vertical axis and the force *p* required to move the shifting member is plotted along the horizontal axis.

The curve 122 represents the force which is exerted by the magnet system on the shifting member in case of constant excitation. In an operative relay, the magnetic force represented by curve 122 must exceed the opposing mechanical force which is to be overcome and which is represented by the curve 123. There is usually a critical point 126, always approximately at the center of the stroke, at which the mechanical force curve contacts the magnetic force curve in the case of a minimum excitation. It is apparent that there are force reserves 127 and 128 at the beginning and end of the stroke and that there are no force reserves at the center.

The mechanical characteristic 123 should conform as closely as possible to the magnetic characteristic 122 so that the same force reserves are available in all parts. This is accomplished by the use of an opposing spring force, exerted by additional springs or in the arrangement according to the invention, by the omega-shaped overcenter springs, which are designed to exert no force at all in the initial position 130 and approximately in the end position 129 whereas they exert a maximum assisting force 131 approximately at the center to compensate the power reserve deficit. The sum of curves 123 and 124 is represented by curve 125. As a result, the magnetic force characteristic 122 conforms closely to the mechanical characteristic 123 so that the excitation requirement of the magnetic system and the energy consumption can be reduced.

We claim:

1. A relay having contact springs operated by a shifting member which is mechanically held in either one or the other of two end positions, comprising:

a shifting member;

a pair of magnetic drive systems each of said magnetic drive systems including an armature for shifting said shifting member from one of said end positions to the other of said end positions;

a pair of overcenter springs coupled to said shifting member at each end thereof such that said overcenter springs bear at one end on said movable shifting member and at the other end on a fixed surface which is connected to said relay;

abutment bearing means on said shifting member and on said fixed surface arranged such that one end of said overcenter springs bear on the abutment bearing means on said shifting member and the other end of said overcenter springs bear on the abutment bearing means on said fixed surface, said abutment bearing means further arranged such that the difference between the distance between the abutment bearing on said shifting member and the distance between said fixed abutment bearings is between zero and substantially the length of the shifting movement of said shifting member.

2. A relay in accordance with claim 1 wherein said overcenter springs are comprised of leaf springs for stabilizing the constraint of said shifting member.

3. A relay in accordance with claim 2 wherein said overcenter springs are bent in omega-shape and are squarely cut at the bearing ends thereof.

4. A relay in accordance with claim 2 wherein said leaf springs are bent in omega-shape and are beaded at the bearings ends thereof.

5. A relay in accordance with claim 1 wherein said abutment bearings for said overcenter springs in said shifting member and on said fixed surface are tub-shaped.

6. A relay in accordance with claim 1 further comprising:

guide means in said shifting member having offset cross-sections; and means fixedly connected to said relay in the yoke thereof which is guided in said guide for preventing false switching in the event of a breakage of an overcenter spring whereby said overcenter spring engages the shoulder of said offset cross-section when said shifting member is canted to prevent movement of said shifting member.

7. A relay in accordance with claim 1 further comprising:

means for securing said relay yokes to said fixed surface for said relay springs, said securing means having an extended portion adaptable to be inserted through a hole in said fixed surface for said relay springs and having a cross-section defining an annular groove which is adapted to receive wedges.

8. A relay in accordance with claim 1 wherein said fixed contact springs are imbedded in a plastic material up to a point thereon which is close to the contact point to stiffen said movable contact springs in and beyond the zone of the contact point such that cutside edges of said relay springs are beaded whereby a reliable opening of contacts which have become welded together is provided.

9. A relay having contact springs operated by a shifting member which is mechanically held in one end position, comprising:

a shifting member;

a magnetic drive system including an armature for shifting said shifting member from said one end position;

a pair of overcenter springs coupled to said shifting member at said one end thereof such that said overcenter springs bear at said one end on said movable shifting member and at the other end on a fixed surface which is connected to said relay and which includes a return spring thereon; and abutment bearing means on said shifting member for receiving one end of said overcenter springs and further abutment bearing means on said fixed surface for receiving the other end of said overcenter springs and arranged such that the abutment bearings on said shifting member are substantially aligned with said further abutment bearings and said shifting member includes shoulder surfaces which are engaged by contact springs to constrain said shifting member.

10. A relay in accordance with claim 9 wherein said overcenter springs are comprised of leaf springs for stabilizing the constraint of said shifting member.

11. A relay in accordance with claim 10 wherein said overcenter springs are bent in omega-shape and are squarely cut at the bearing ends thereof.

12. A relay in accordance with claim 10 wherein said leaf springs are bent in omega-shape and are beaded at the bearings ends thereof.

13. A relay in accordance with claim 9 wherein said abutment bearings for said overcenter springs in said shifting member and on said fixed surface are tub-shaped.

14. A relay in accordance with claim 9 further comprising:

guide means in said shifting member having offset cross-sections; and means fixedly connected to said relay in the yoke thereof which is guided in said guide for preventing false switching in the event of a breakage of an overcenter spring whereby said overcenter spring engages the shoulder of said offset cross-section when said shifting member is canted to prevent movement of said shifting member.

15. A relay in accordance with claim 9 further comprising:

means for securing said relay yokes to said fixed surface for said relay springs, said securing means having an extended portion adaptable to be inserted through a hole in said fixed surface for said relay springs and having a cross-section defining an annular groove which is adapted to receive wedges.

16. A relay in accordance with claim 9 wherein said fixed contact springs are imbedded in a plastic material up to a point thereon which is close to the contact point to stiffen said movable contact springs in and beyond the zone of the contact point such that cutside edges of said relay springs are beaded whereby a reliable opening of contacts which have become welded together is provided.

* * * * *